US010731919B1

(12) United States Patent
Gutierrez et al.

(10) Patent No.: US 10,731,919 B1
(45) Date of Patent: Aug. 4, 2020

(54) COOLER WITH INTERNAL TEMPERATURE MONITOR

(71) Applicants: John Gutierrez, Mandeville, LA (US); Aamar Quershi, Katy, TX (US)

(72) Inventors: John Gutierrez, Mandeville, LA (US); Aamar Quershi, Katy, TX (US)

( * ) Notice: Subject to any disclaimer, the term of this patent is extended or adjusted under 35 U.S.C. 154(b) by 663 days.

(21) Appl. No.: 14/986,957

(22) Filed: Jan. 4, 2016

Related U.S. Application Data

(60) Provisional application No. 62/219,011, filed on Sep. 15, 2015.

(51) Int. Cl.

| | |
|---|---|
| ***G01K 13/00*** | (2006.01) |
| ***F25D 29/00*** | (2006.01) |
| ***F25D 3/08*** | (2006.01) |
| ***F25D 27/00*** | (2006.01) |

(52) U.S. Cl.
CPC ..... *F25D 29/003* (2013.01); *F25D 3/08* (2013.01); *F25D 27/00* (2013.01)

(58) Field of Classification Search
CPC ..... F25D 23/026; F25D 2400/08; F25D 2700/12; F25D 23/12; F25D 27/005; F25D 3/08
See application file for complete search history.

(56) References Cited

U.S. PATENT DOCUMENTS 6,089,146 A * 7/2000 Nam ..... A23B 7/10 435/286.1
6,116,029 A * 9/2000 Krawec ..... A24F 25/02 62/3.3
6,581,391 B2 * 6/2003 Horey ..... C12Q 1/6837 62/138
8,925,752 B2 * 1/2015 Smith ..... F25D 3/08 220/23.4
9,132,598 B2 * 9/2015 Ernst ..... B30B 9/321
9,200,831 B2 * 12/2015 Lauchnor ..... F25D 31/007
9,726,424 B1 * 8/2017 Sandberg ..... F25D 27/005
2007/0193297 A1 * 8/2007 Wilson ..... F25D 29/00 62/371
2007/0295632 A1 * 12/2007 Palisin ..... B65D 7/04 206/515
2008/0302126 A1 * 12/2008 Falkenberg ..... F25D 3/08 62/457.1
2009/0188272 A1 * 7/2009 Cloutier ..... F25D 13/04 62/378
2011/0154852 A1 * 6/2011 Cavazos ..... F25D 3/06 62/457.7
2014/0182321 A1 * 7/2014 Constablle ..... F24F 13/22 62/291
2015/0204598 A1 * 7/2015 Affleck ..... B65B 3/003 700/228
2016/0239802 A1 * 8/2016 Burch V ..... H04W 4/70
2017/0067682 A1 * 3/2017 Spinks ..... F25D 23/12

* cited by examiner

*Primary Examiner* — Henry T Crenshaw
*Assistant Examiner* — Kamran Tavakoldavani
(74) *Attorney, Agent, or Firm* — Kenneth L Tolar

(57) ABSTRACT

A cooler includes a housing having a bottom surface, a front wall, a rear wall, two opposing sidewalls and an open top in communication with an interior storage chamber. A pivotal lid encloses the open top to provide selective access to the interior storage chamber. The lower surface of the lid includes a sensor that measures temperature, pressure and humidity within the interior chamber, and transmits the measured data to a portable electronic device to allow a remote user to monitor the condition of stored ice without opening the lid.

21 Claims, 6 Drawing Sheets

COOLER WITH INTERNAL TEMPERATURE MONITOR

CROSS REFERENCE TO RELATED APPLICATIONS

This application is entitled to the benefit of provisional patent application No. 62/219,011 filed on Sep. 15, 2015, the specification of which is incorporated herein by reference.

BACKGROUND OF THE INVENTION

The present invention relates to a portable cooler having a sensor that wirelessly transmits temperature and other atmospheric parameters within a cooling chamber to a portable electronic device to alert a remote user whenever ice should be replenished.

DESCRIPTION OF THE PRIOR ART

Many people use a portable cooler when participating in various outdoor events in order to chill food and beverages. Too often, the cooling chamber is initially loaded with food, beverages and ice, but is thereafter ignored as users become distracted by other activities. Eventually, someone returns to the cooler to discover that the ice has melted and that the contents are unacceptably warm or spoiled. Even if a conscientious user routinely inspects the cooling chamber, repeatedly opening the lid needlessly exposes the ice to warmer ambient air and accelerates melting.

Accordingly, there is currently a need for a cooler that allows a user to inspect contained ice without repeatedly opening a lid. The present invention addresses this need by providing a cooler having a sensor that wirelessly transmits atmospheric parameters within a cooling chamber to a portable electronic device to allow a user to remotely determine whether an ice supply should be replenished.

SUMMARY OF THE INVENTION

The present invention relates to a cooler comprising a housing having a bottom surface, a front wall, a rear wall, two opposing sidewalls and an open top in communication with an interior storage chamber. Hingedly attached to an upper edge of the rear wall is a lid that encloses the open top to provide selective access to the interior storage chamber. The lower surface of the lid includes a sensor for measuring temperature, pressure and humidity within the interior chamber. The measured data is wirelessly transmitted to a portable electronic device to allow a remote user to monitor the condition of stored ice without opening the lid. An LED module positioned on the lower surface of the lid is activated only when the lid is open and ambient light is minimal to illuminate the interior chamber.

It is therefore an object of the present invention to provide a cooler having a sensor in wireless communication with an electronic device for instantly determining ambient conditions within an interior cooling chamber.

It is another object of the present invention to provide a cooler having a light module that is activated only when a lid is opened and ambient light is inadequate.

It is yet another object of the present invention to provide a cooler having an unobtrusive locking means for preventing unauthorized access to an interior ice chamber.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
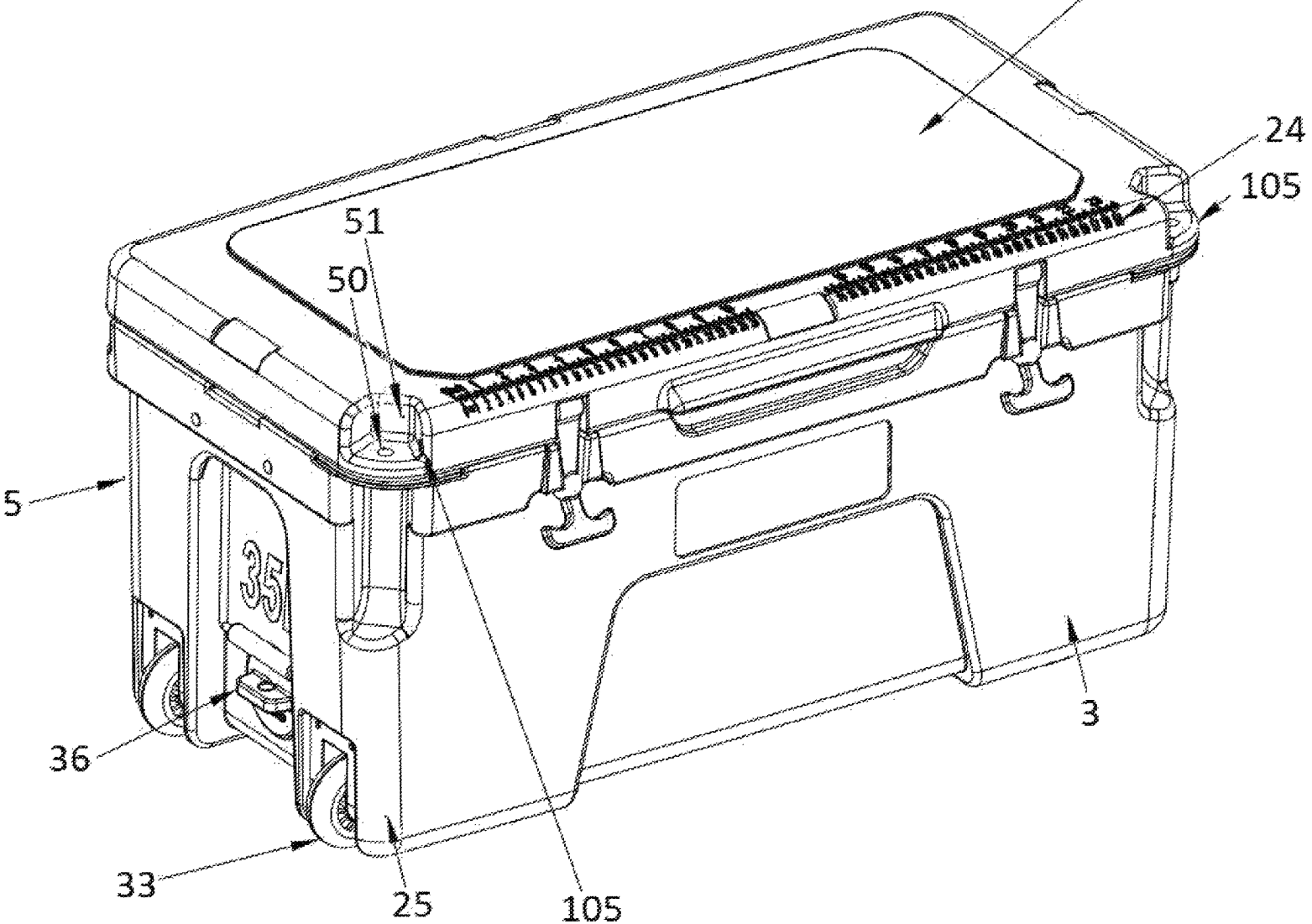
FIG. 1 is a perspective view of the cooler according to the present invention.
Figure 2:
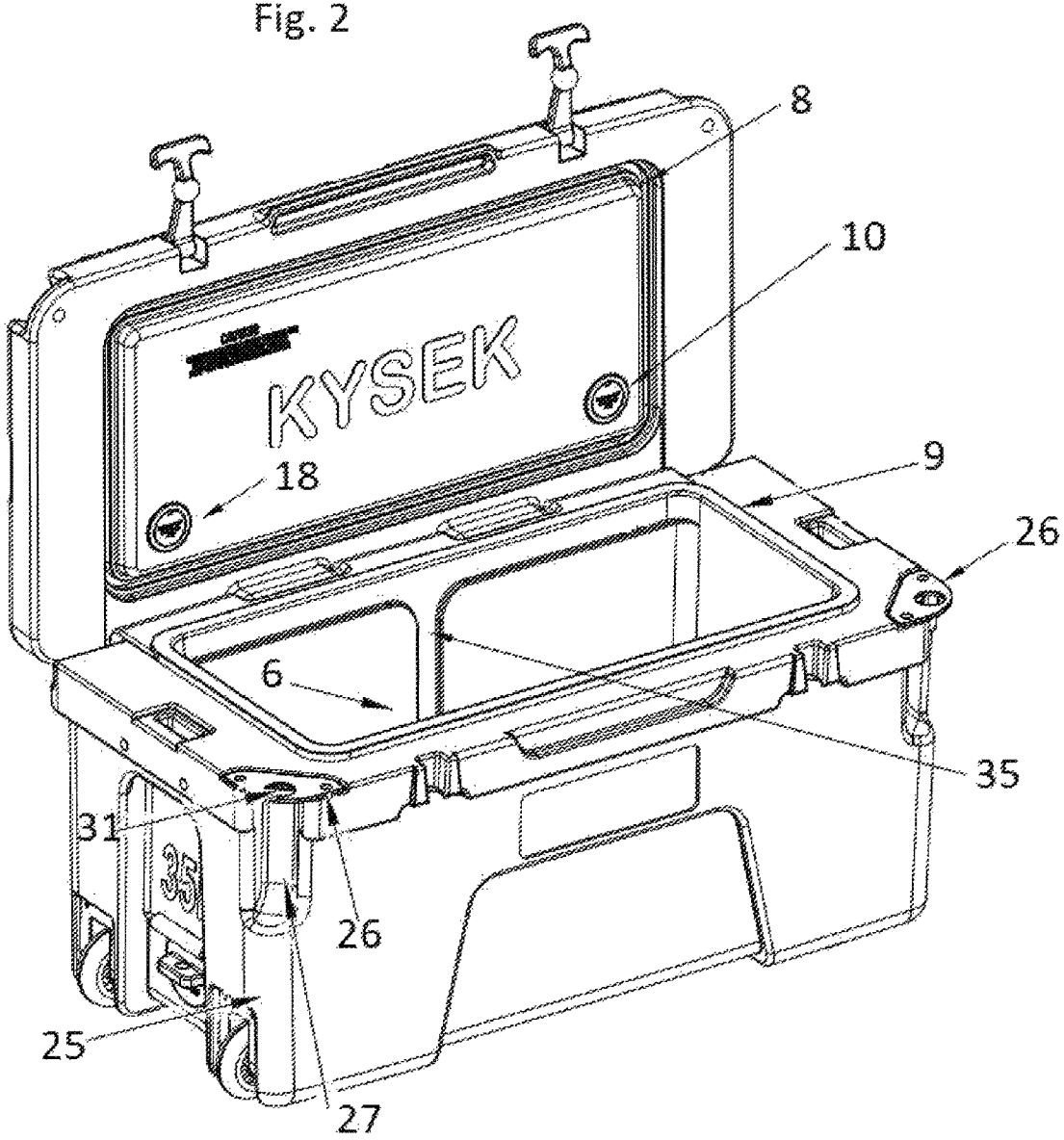
FIG. 2 is a perspective view of the cooler with the lid in an open position.
Figure 3:
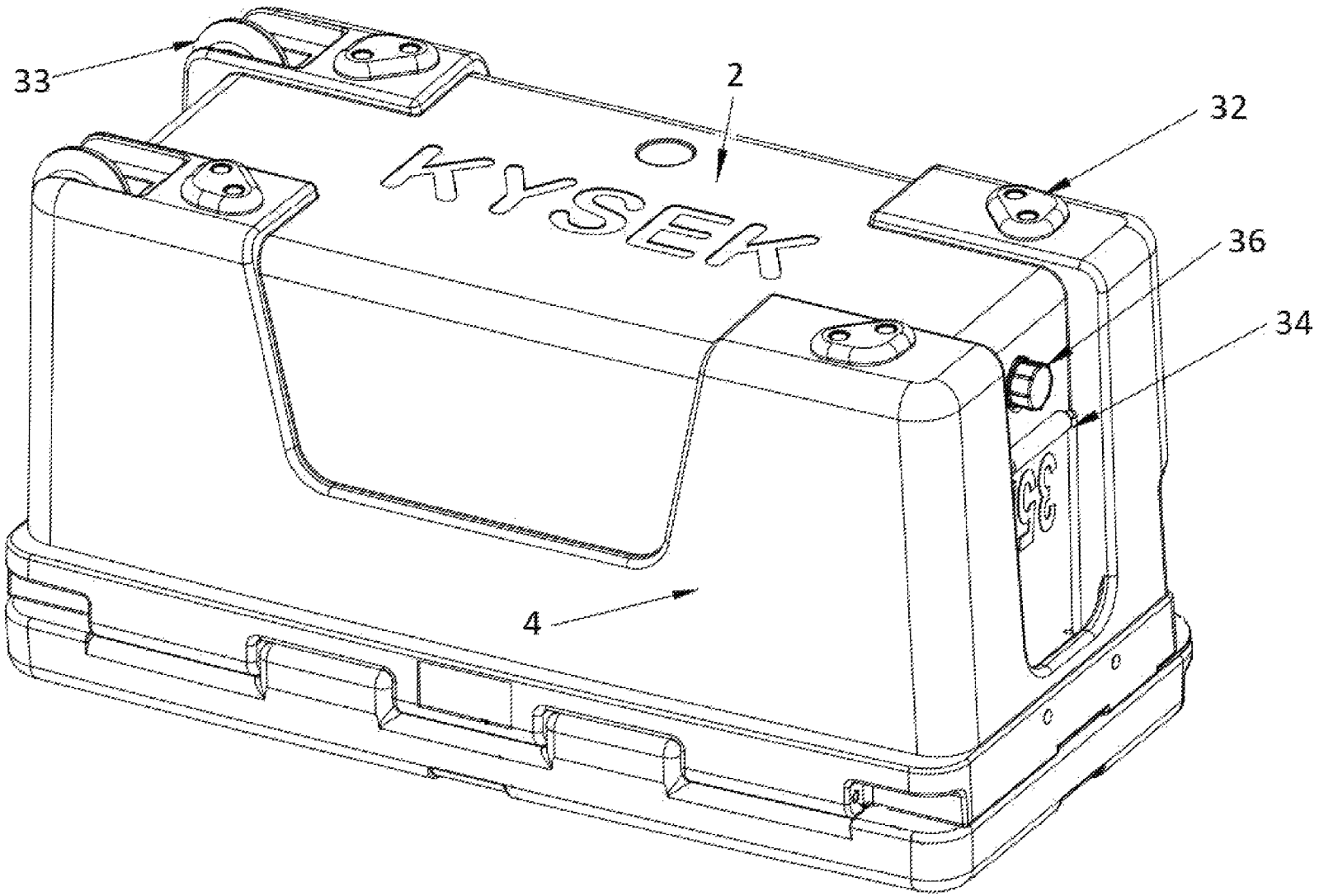
FIG. 3 is an inverted, perspective view of the cooler.

The present invention relates to a cooler comprising a housing 1 having a bottom surface 2, a front wall 3, a rear wall 4, two opposing sidewalls 5 and an open top in communication with an interior storage chamber 6. Hingedly attached to an upper edge of the rear wall is a lid 7 that selectively encloses the open top to provide access to the interior storage chamber. On the lower surface of the lid is a rectangular groove with a gasket 8 received therein for creating an airtight seal between the lid and a second gasket 9 on an upper rim of the housing.

The lower surface of the lid further includes a first cavity that removably receives a sensor 10 for measuring various atmospheric parameters within the storage chamber. The sensor includes a disk-shaped housing having a temperature sensor 11, a humidity sensor 12 and a barometer therein 13, each in communication with a wireless transmitter 14, such as that commonly marketed and sold under the trademark Bluetooth™. The transmitter is in discrete wireless communication with a select portable electronic device 15 having a specialized application thereon. The portable electronic device can be a smart phone, a tablet computer or a similar device. By opening the application, a carrier of the portable electronic device can view the current temperature, relative humidity and pressure within the interior storage chamber, and other data as explained in more detail below.

The sensor further includes a microcontroller 16 that initiates transmission of data and various alerts to the portable electronic device. For example, the user receives an alert if the temperature within the interior chamber is above a preselected threshold so that the user can quickly return to reload ice.

Figure 4:
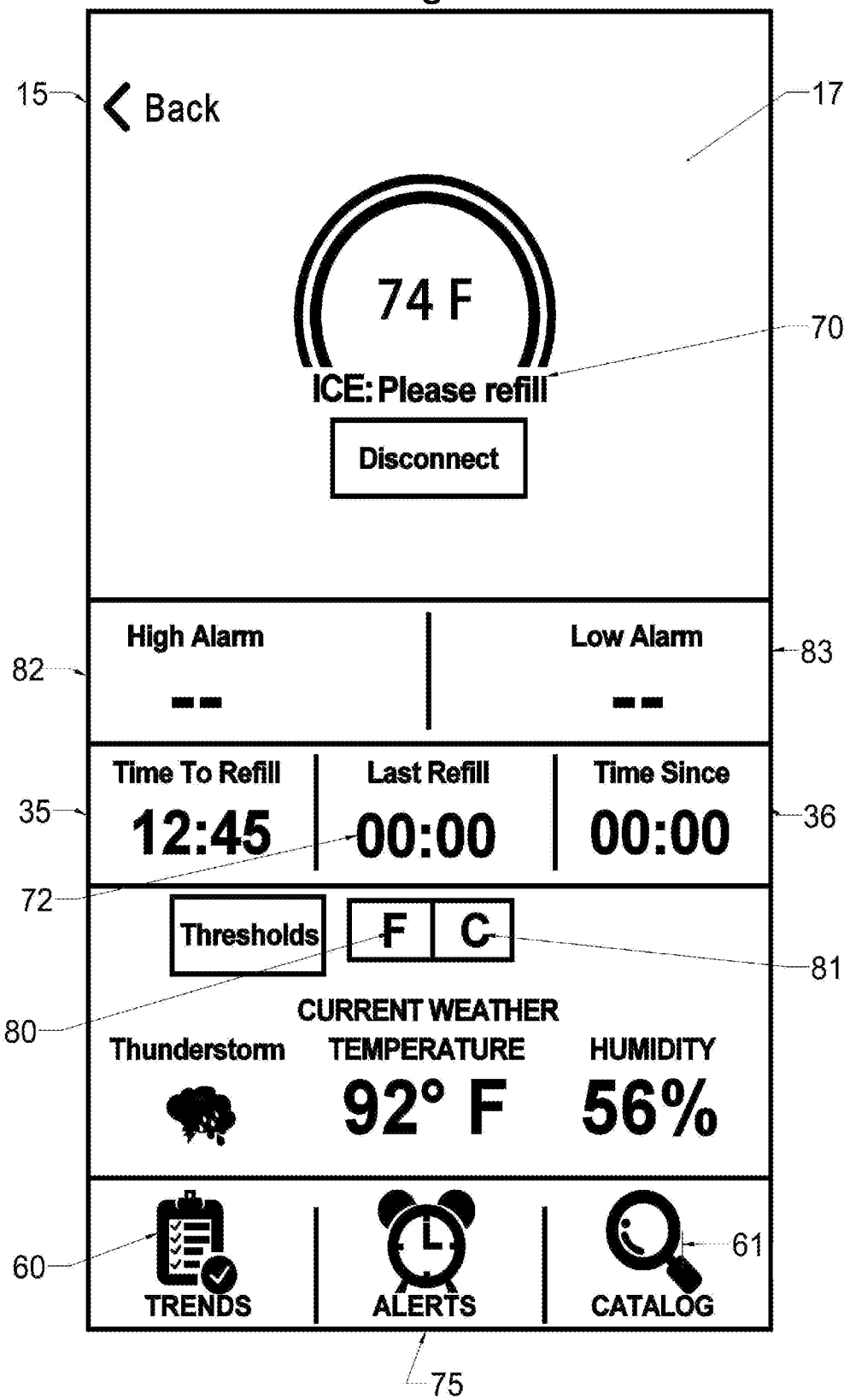
FIG. 4 is a plan view of a portable electronic device depicting the pertinent sensor data.
Figure 5:
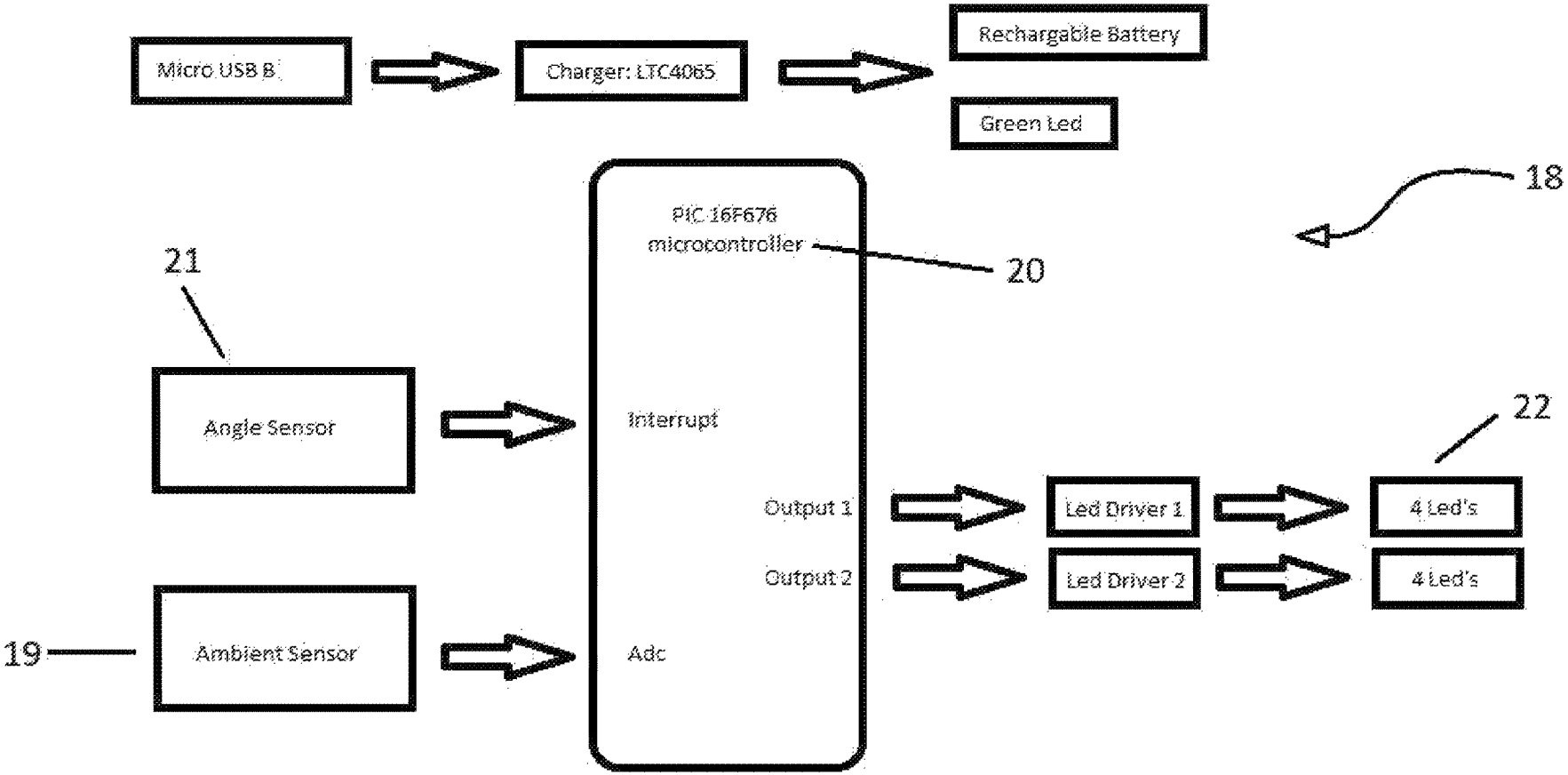
FIG. 5 is a block diagram of the light module circuit.
Figure 6:
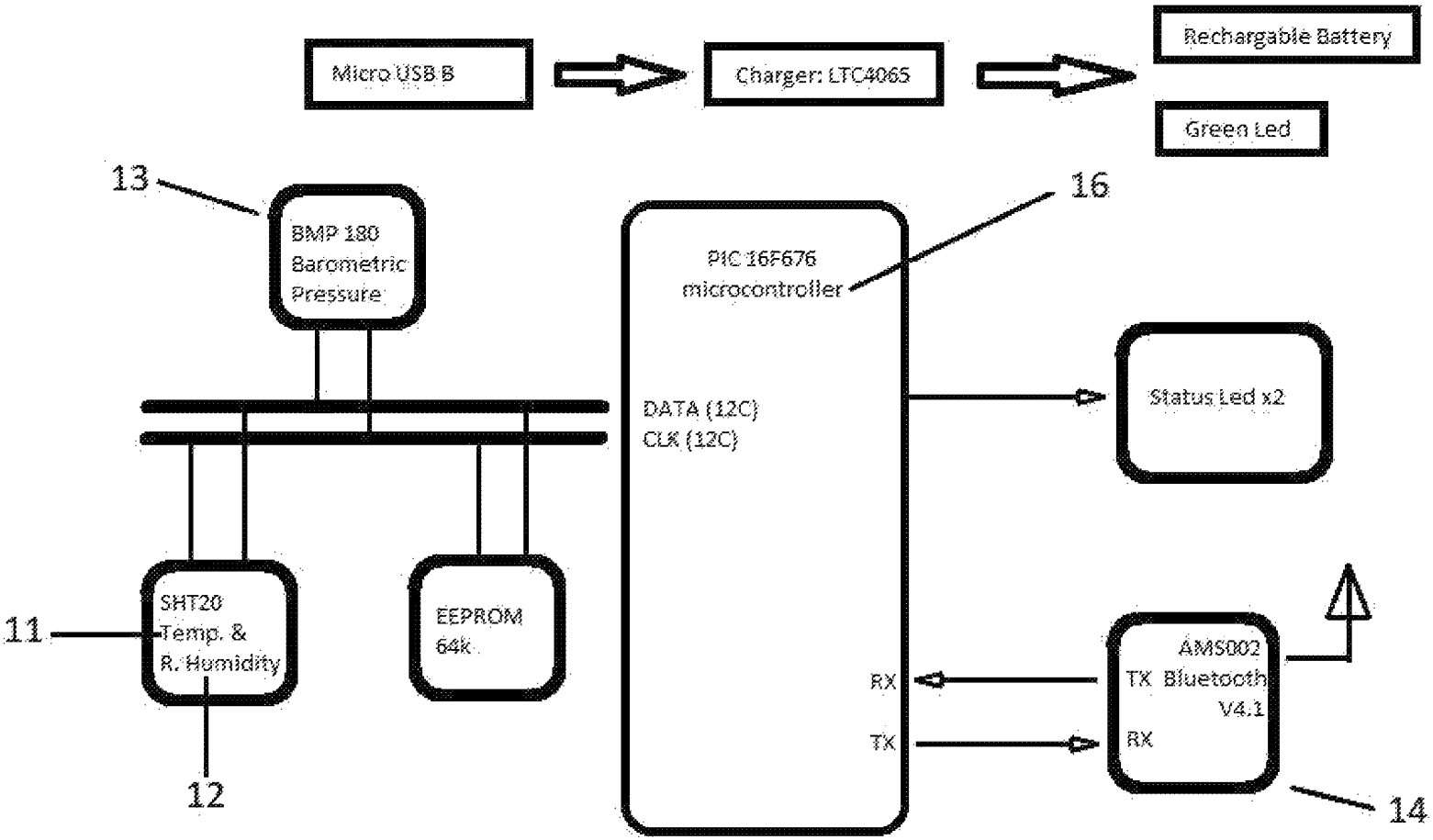
FIG. 6 is a block diagram of the sensor circuit.

Referring specifically now to FIG. 4, when opened, the application will generate a home screen 17 on the electronic device where a user can view measured data and other conditions. For example, the user can readily determine the current temperature within the storage chamber and an ice condition identifier 70, such as "please refill." The screen automatically depicts other informational data, such as an estimated remaining life 35 of the current ice inventory, a time of a previous refill 72 and an elapsed time 36 since a last refill. A "trend" button 60 allows a user to generate charts for a given parameter and a "catalogue" button 61 allows the user to review all historical data. An "alert" button 75 generates a list of all prior alarm events. Other buttons allow a user to designate temperature units, i.e., ° F. or ° C. 80,81, and high 82 and low-temperature 83 alarm thresholds. The application also interacts with the electronic device's GPS and other third-party applications to display current weather conditions in the area.

A second cavity on the lower surface of the lid removably receives a light module 18 having a photosensor 19, a microprocessor 20 and a rolling-ball inclinometer 21 therein for illuminating the interior chamber only when the lid is open and ambient light is insufficient or absent. The module includes a disk-shaped housing similar to the sensor housing having a plurality of LEDs 22 therein. If the inclinometer determines that the lid is open and ambient light is below a minimal threshold, the microprocessor activates all of the LEDs for a predetermined duration. After the predetermined duration, a portion of the LEDs are disabled for a second predetermined duration, after which all LEDs are deactivated.

On a top surface of the lid is a textured portion 23 that provides both a cutting board and a non-skid surface on which a user can stand. Adjacent to the textured portion is a ruler 24 that is incremented in both British and metric units. The lid further includes a pair of front corners 106, each having an apertured plate 105 positioned within a notch 51 for receiving a padlock shackle as described in more detail below.

The housing also includes a pair of opposing front corners 25, each having a panel 26 superimposed on an elongated, vertical indention 27. The panel includes a hole 31 that aligns with an aperture 50 on one of the plates 105 when the lid is closed for receiving a padlock shackle to prevent unauthorized access to the interior chamber. Each hole 31 preferably has a bear-claw outline so that the panel can also function as a bottle opener. The elongated, vertical indentions provide a nest for the padlock body so that it does not obtrusively protrude from the cooler housing.

On the bottom surface of the housing are a plurality of footpads 32 for anchoring the housing on an underlying surface. A pair of indented wheels 33 and recessed rope handles 34 on the sidewalls assist a user with transporting the device. The wheels are part of an independent unit that is incorporated into the cooler including an aluminum axle and a sealed ball-bearing mechanism. Each wheel unit is installed within a designated channel formed in the housing and is designed to distribute the overall load within the cooler to the independent unit, which is critical when tilting the cooler housing above a predetermined angle.

On the inner surface of the front and rear walls is a groove 35 that slidably receives an ice-pack divider for selectively segregating the storage chamber into compartments, if desired. The bottom surface of the housing is slanted downwardly from the rear wall toward the front wall to maintain the lid in an open position when released. A capped drain plug 36 on each sidewall allows accumulated water to be quickly removed from the interior chamber.

As is readily apparent from the detailed description above, the present invention provides a new and improved cooler that can be easily monitored from a remote location and without opening a lid. Furthermore, the unique sensor and light module can be easily removed from their designated cavities and repaired, replaced or inspected with minimal effort.

The above-described device is not limited to the exact details of construction and enumeration of parts provided herein. For example, though the sensor is primarily depicted and described as measuring temperature, pressure and humidity, virtually any type of ambient parameter can be measured and monitored. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A portable cooler comprising:

a housing having at least one outer wall and an open top in communication with an interior storage chamber for storing ice;

a pivotal lid superimposed on the open top for providing selective access to the interior storage chamber;

means for measuring a temperature within the interior storage chamber to determine if the ice should be replenished.

2. The portable cooler according to claim 1 wherein said means for measuring a temperature within the interior storage chamber comprises a temperature sensor on a lower surface of said lid.

3. The portable cooler according to claim 2 further comprising:

a light module positioned on the lower surface of said lid;

means for activating said light module only when said lid is in an open position and ambient light is below a predetermined threshold.

4. The portable cooler according to claim 1 further comprising a means for transmitting said temperature within the interior storage chamber to a remote electronic device.

5. The portable cooler according to claim 1 further comprising a means for measuring atmospheric pressure and humidity within said interior storage chamber.

6. The portable cooler according to claim 1 further comprising:

an indention on said at least one outer wall;

plate superimposed on said indention, said plate having a hole;

a panel on said lid, said panel having an aperture thereon that aligns with said hole when said lid is closed for receiving a padlock shackle to prevent unauthorized access to said interior storage chamber, and wherein said indention provides a receptacle for unobtrusively concealing a padlock body.

7. The portable cooler according to claim 6 wherein said hole has a bear-claw outline so that the panel also functions as a bottle opener.

8. The portable cooler according to claim 1 wherein said housing further includes a front wall, a rear wall, and a bottom surface that is slanted downwardly from the rear wall toward the front wall to maintain the lid in an open position when released.

9. A portable cooler comprising:

a housing having at least one outer wall and an open top in communication with an interior storage chamber;

a pivotal lid superimposed on the open top for providing selective access to said interior chamber, said lid having an upper surface and a lower surface;

a sensor housing removably positioned on the lower surface of said lid, said sensor housing having a temperature sensor therein for measuring a temperature within the interior storage chamber to determine a current condition of ice therein.

10. The improved portable cooler according to claim 9 wherein said sensor housing further includes a humidity sensor and a barometer therein.

11. The portable cooler according to claim 10 further comprising a light module removably positioned on the lower surface of said lid.

12. The portable cooler according to claim 11 further comprising a means for activating said light module only when said lid is in an open position and ambient light is below a predetermined threshold.

13. The portable cooler according to claim 12 wherein said sensor housing and said light module each removably seat within a designated cavity on the lower surface of said lid.

14. The portable cooler according to claim 11 further comprising:

said light module including a plurality of LEDs;

a means for activating said light module for a predetermined duration only when said lid is in an open position and ambient light is below a predetermined threshold;

means for disabling a portion of the LEDS for a second predetermined duration after the expiration of the first predetermined duration;

means for disabling a remainder of the LEDs after the expiration of the second predetermined duration.

15. The portable cooler according to claim 9 further comprising a textured portion on the upper surface of said lid that provides both a cutting board and a non-skid surface on which a user stands.

16. The portable cooler according to claim 15 further comprising a ruler adjacent to the textured portion that is incremented in both British and metric units.

17. A portable cooler comprising:

a housing having at least one outer wall, a bottom surface and an open top in communication with an interior storage chamber for storing ice;

a pivotal lid superimposed on the open top for providing selective access to the interior storage chamber;

means for measuring a temperature within the interior storage chamber to determine if the ice should be replenished, wherein said means comprises a temperature sensor on a lower surface of said lid;

a means for transmitting said temperature within the interior storage chamber to a remote electronic device.

18. The portable cooler according to claim 17 further comprising a plurality of footpads on the bottom surface of the housing for anchoring the housing on an underlying surface.

19. The portable cooler according to claim 17 further comprising a pair of indented wheels on a lower edge of the outer wall to assist a user with transporting the device.

20. The portable cooler according to claim 19 wherein said wheels are each an independent unit installed within a designated channel formed in the housing, said unit including an aluminum axle and a sealed ball-bearing mechanism to distribute an overall load within the interior chamber to the independent unit.

21. The portable cooler according to claim 17 further at least two opposing interior walls each having a groove thereon that slidably receive an ice-pack divider for selectively segregating the storage chamber into compartments, if desired.

* * * * *